United States Patent [19]

Goldstein

[11] Patent Number: 4,551,159

[45] Date of Patent: Nov. 5, 1985

[54] ICE MAKING MACHINE AND METHOD

[76] Inventor: Vladimir Goldstein, 18 Killaloe Rd., Unit 4, Concord, Ontario, Canada, L4K 1C8

[21] Appl. No.: 687,764

[22] Filed: Dec. 31, 1984

Related U.S. Application Data

[63] Continuation-in-part of Ser. No. 26,561, Apr. 3, 1979, abandoned, which is a continuation-in-part of Ser. No. 197,553, Oct. 16, 1980, abandoned, which is a continuation-in-part of Ser. No. 419,548, Sep. 17, 1982, abandoned.

[51] Int. Cl.[4] ..... B01D 9/04; C02F 1/22

[52] U.S. Cl. ..... 62/541; 62/544

[58] Field of Search ..... 62/66, 67, 123, 532, 62/544, 541

[56] References Cited

U.S. PATENT DOCUMENTS

| | | | |
|---|---|---|---|
| 1,641,429 | 9/1927 | Heyman et al. | 62/123 |
| 2,259,841 | 10/1941 | Spiegl | 62/67 X |
| 3,012,409 | 12/1961 | Ashley | 62/67 X |
| 3,049,889 | 8/1962 | Carfagno | 62/58 |
| 3,092,673 | 6/1963 | Rush | 62/544 X |
| 3,328,972 | 7/1967 | Svanoe | 62/123 |
| 3,347,058 | 10/1967 | Svanoe | 62/544 X |

*Primary Examiner*—William E. Tapolcai

*Attorney, Agent, or Firm*—McCarthy & McCarthy

[57] ABSTRACT

The invention is a method for making ice in a container the side walls of which are cooled to cool a solution of less than eutectic concentration to form ice crystals wherein the sides of the container are continuously mechanically scoured at a rate that prevents the formation of ice crystals on the wall of the container when the heat exchange relation of the solution with the side of the chamber is at least 4000 BTU's per square foot of container side.

15 Claims, 2 Drawing Figures

ICE MAKING MACHINE AND METHOD

Figure 1:
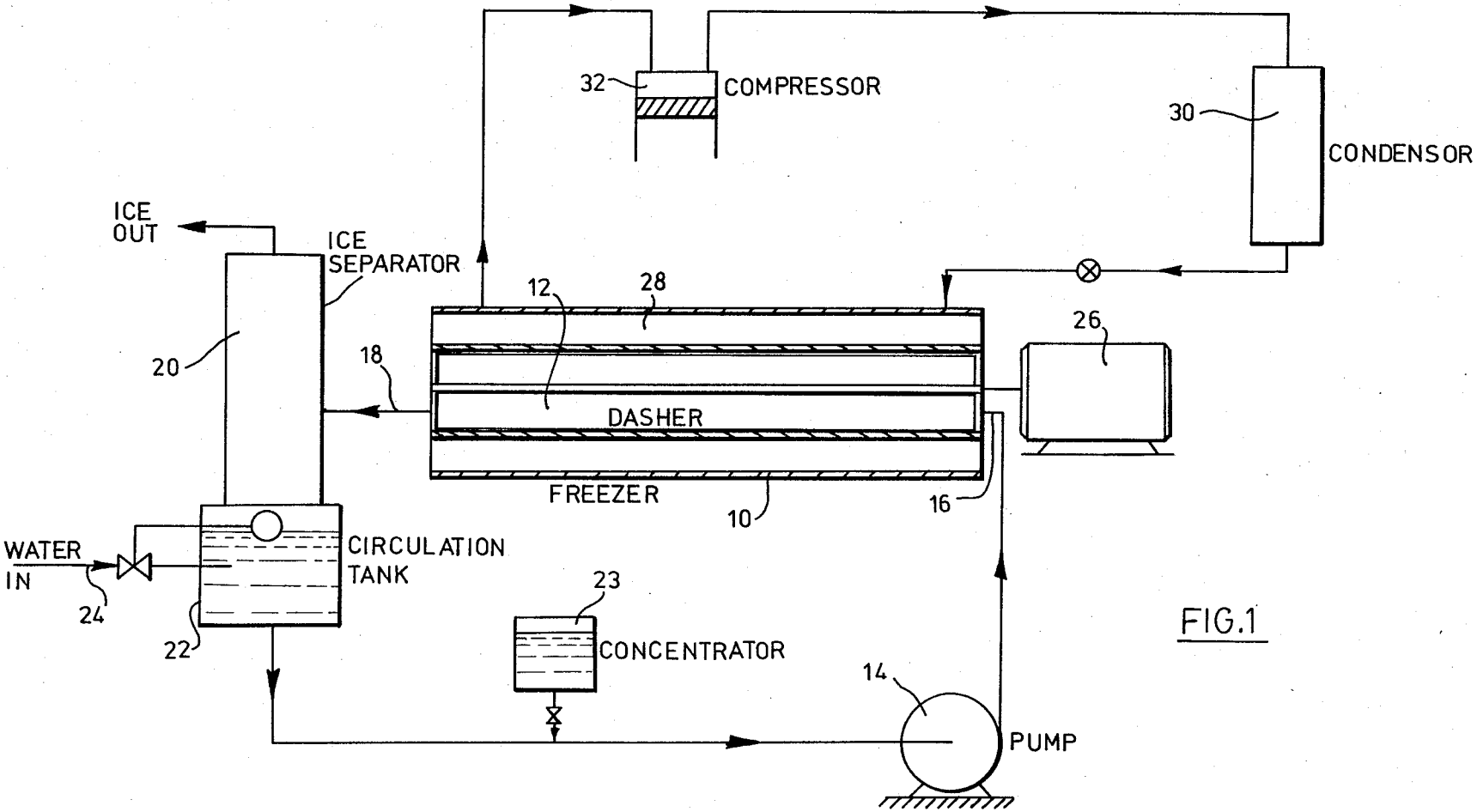

This invention relates to a continuous method for making ice and is a continuation-in-part of Application Ser. No. 026,561 filed on Apr. 3, 1979, now abandoned, Application Ser. No. 197,553 filed on Oct. 16, 1980, now abandoned, and Application Ser. No. 419,548 filed on Sept. 17, 1982, now abandoned.

In today's society vast quantities of ice are used in the preservation and processing of food products. By way of example it is considered that two pounds of ice are required for each pound of fresh poultry that is retailed. The fishing industry, the dairy industry and the fruit and vegetable industry are also large consumers of ice. Service industries such as hotel, restaurant and hospital also use large quantities. Further, ice is consumed in large amounts in many manufacturing industries.

The manufacture of ice is, therefore, of itself, an important industry. A good proportion of ice manufactured today is manufactured in block on a batch basis. This is a relatively inefficient method. It is labour oriented and time consuming because the large blocks of ice produced take up to 48 hours to form. Inefficiency is increased by the requirement to use heat to melt the bond between the ice and the evaporator. The cost of providing this heat in the harvesting step along contributes substantially to the inefficiency of the process. Notwithstanding these inefficiencies, however, the method continues to be used.

There are also continuous method of making ice in current use with mixed success. In the continuous methods of making ice presently used ice is formed from water on the walls of an evaporator from which it must be broken away by a rotating auger. Variations of bond strength and irregular pattern of ice formation have caused an irregular torque requirement for the auger shaft drive. The irregularity of this torque requirement has been such that many attempts at evaporator designs for continuous ice making machines have failed.

It is known to take a mixture that is less than eutectic concentration, contain it in container, agitate the mixture, and cool the sidewall of the container to crystalize water in the solution and concentrate the remainder. Such a general method is the basis for making ice cream. The method has also been proposed to be used for the concentration of the eutectic solution in the case where the solution is, for example, brewed coffee or orange juice. Such a proposal is found in U.S. Pat. Nos. 3,328,972 and 3,328,058 to Svanoe.

In the Svanoe reference a coffee or like brew is described and the brew is concentrated by the continuous removal of ice crystals which are formed. In this patent the brew mixture is contained in a container and the sidewall is cooled to cool the mixture below its freezing point and form ice crystals which are removed. It is necessary to prevent crystal formation on the sidewall of the container and Svanoe discloses the achievement of this by operating agitators to maintain a turbulent zone of annular cross section defined by the ends of the agitators and the cooling wall of the container. The turbulence of the liquid in this zone scours the sidewall to prevent crystals of ice from building up. The mixture is subcooled in the turbulent zone and passes therefrom to the centre area where larger harvestable water ice crystals grow. These larger water ice crystals are removed to yield a more concentrated brew. In the disclosed method ice making is not the end object but ice is a byproduct. Concentration of the brew is the object of the method.

The method of Svanoe is a very delicately balanced method and operating conditions must be carefully controlled. It is important that ice crystals should not form on the sidewall of the container. This would stop the process. They must be directed to the centre of the container before they reach harvestable size. If the Svanoe method is capable of doing this at all it is capable of doing it under difficult to control conditions only and only at a rate that would not give any reasonable production of ice if the method were extended as a means of producing ice as a marketable end product.

In his specification, Svanoe expresses concern about the formation of ice crystals on the container wall. The reason is that if ice crystals form on the container wall the process is stopped because the general process essentially is subcooling the mixture at the container wall and removing it to the centre area where it can grow into crystals at a reasonable rate for crystal removal. Thus, prevention of the formation of ice crystals on the container wall is important and Svanoe achieves this by maintaining a high agitation zone close to the wall of the container. As noted above, the agitated liquid close to the container wall sours the wall and removes ice particles before they grow to harvestable size. This method, however, is not efficient. As appears from Svanoe's specification at column 7, line 42, heat is transferred through the heat transfer surface of the container at a rate of about 300 to 1600 BTU's per square foot per hour. To increase this heat transfer rate with the Savnoe method would result in crystal build-up on the container wall and breakdown of the method. A good many precautions are necessary in order to get even this relatively low heat transfer with Svanoe. For example, he must provide for feed-back of ice crystals in order to provide for crystal growth. He must also accurately control temperature differentials throughout the system. Thus, his method is capable of only a low rate of heat transfer and it is delicately balanced. It is not efficient enough from a capacity point of view to produce ice on a commercial basis.

The Svanoe method is inefficient. It is possible to operate equipment of the Svanoe type with applicant's method and achieve a water ice output of over ten times that of Svanoe. Svanoe claims in his specification to be able to transfer about 300 to 1600 BTU's per square foot per hour by using the applciant's invention.

The applicant scours differently from Svanoe and is able thereby to maintain a critical temperature range at the heat transfer surface to effectively avoid crystalization at the surface thereby increasing the the ice making efficiency to a most remarkable extent.

The essential difference in the applicant's method and the method of Svanoe is that in the case of the applicant's method the inside of the heat transfer surface is mechanically scoured to prevent the formation of water ice crystals. Svanoe uses an entirely different method for attempting to move a super cooled layer of liquid from the surface to the centre and the difference is critical to the achievement of applicant's improved results.

Other patentees in this field, such as Spiegl, form crystals on the side of the container and scrape them. This is a very inefficient method of forming crystals and results in a very low transfer of cooling from refrigerant through the container wall for a given size container.

Svanoe proposed the concept of subcooling the surface layer of liquid in the container and transferring it from the surface to the interior, but he did not know how to effectively put the concept into practice to get higher yield. With Svanoe the subsurfce layer is cooled substantially more than one degree below the freezing point and the formation of ice crystals at the cooling system is inevitable. When this occurs the system breaks down the the efficiency reverts to that of Spiegl where crystals are scraped from the container wall. Applicant avoids the inevitable breakdown of the system disclosed in Svanoe and is able to maintain a high rate of heat transfer and ice crystal production.

Scouring will permit one to operate the system without danger of forming ice crystals on the wall and this is, in numerical terms done by cooling the layer of mixture immediately adjacent the side wall of the containner no more than 1° below the freezing point of the mixture in the chamber. The turbulence described in the Svanoe patent is not capable of removing the surface layer at a rate to keep the temperature within the one degree limit if the wall is cooled at a rate of at least 4000 BTU's per square foot of container wall. The combination of these things is not possible with Svanoe with the result that Svanoe is not able to approach any where near the efficiency of the applicant.

The object of this invention is to provide a method for producing ice on a continuous basis that is simple, reliable, free from major operating problems, employs simply designed equipment and is economical.

A continuous method for making ice comprises the steps of making a mixture wherein the solvent is water, the solute is nontoxic and the initial concentration is less than the eutectic concentration; containing the mixture within a container, the mixture being in heat exchange relation with the side wall of the container; continuously cooling the side wall of the container to cool the layer of mixture immediately adjacent the side wall no more than 1 degree below its freezing point with a refrigerant at a rate of at least 4000 BTU's per square foot of cooled container wall per hour; continuously mechanically scouring the side wall of the container to continuously carry the cooled layer of mixture at the sidewall towards the centre of the container; the rate of scouring being fast enough to carry the cooled layer of mixture at the sidewall towards the centre of the container as aforesaid before the cooled layer is crystalized into a layer of ice whereby to lower the temperature of the mixture substantially uniformly throughout the container below its freezing point and form ice crystals of harvestable size suspended throughout the body of the mixture in the chamber; harvesting formed ice cystals from suspension in said mixture; and continuously replenishing said mixture in said chamber as said water ice crystals are removed.

Figure 2:
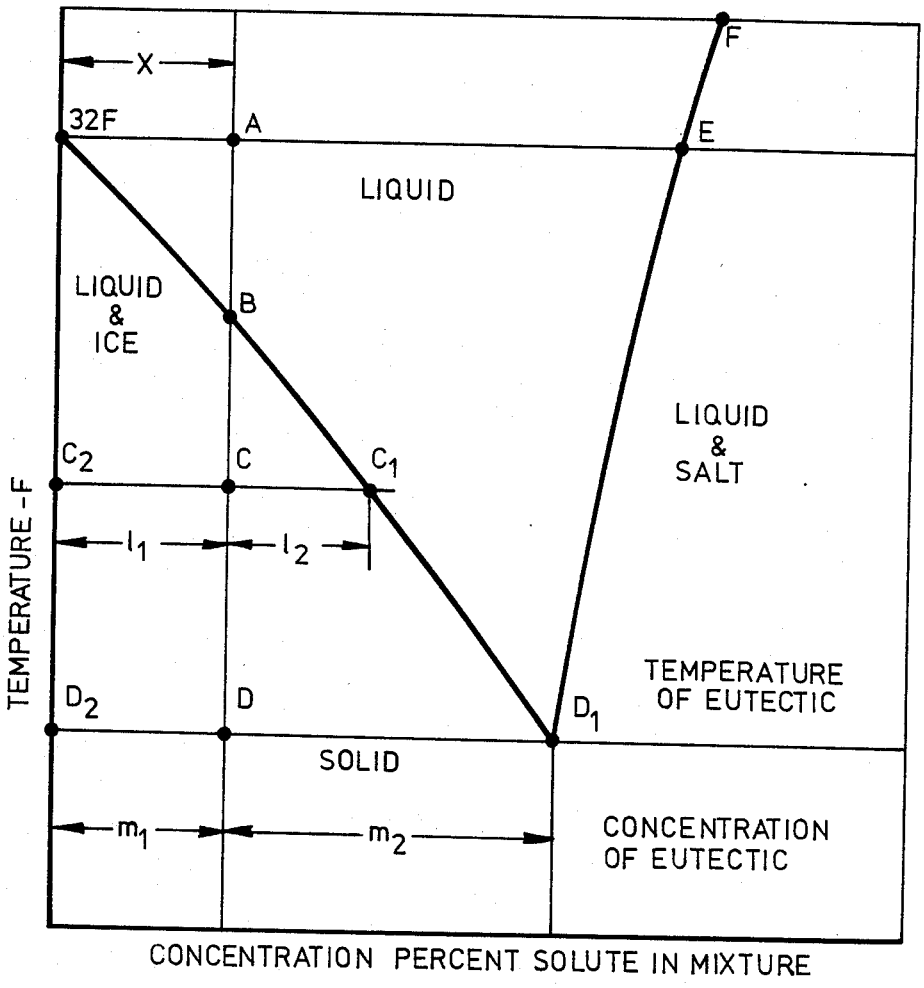

In the drawings:

FIG. 1 is a schematic illustration of apparatus for practising the invention; and FIG. 2 is an illustration of a temperature concentration curve for a brine mixture.

This invention has been successfully practiced using the freezing system of a Neopolitan Vogt-Model V3100 ice cream freezer and a NaCl brine mixture and it will be described having regard to that apparatus and mixture. It is, however, not intended that the invention be limited to that apparatus or that mixture.

In FIG. 1 the numeral 10 refers to a freezing cylinder. It has a dasher chamber 12 through which a brine mixture is continuously circulated by means of the pump 14. The brine mixture enters the chamber as at 16, is cooled therein to form ice crystals as will be referred to later and leaves the chamber from exit port 18 as a pumpable slush-like mixture. It then proceeds to a mechanical separator 20, which in the apparatus successfully operated to date consists of a strainer that holds the ice crystals and permits the liquid of the mixture to pass through. The ice crystals are removed and the remaining mixture is conducted to the circulation tank 22. Water from the supply 24 is added to the circulation tank to replace the water taken from the brine mixture by removal of the ice crystals. Thus, the water that makes the ice is added to the system as make-up water. Numeral 23 is a tank containing concentrated solute which can be added to the system as required to replace lost solute.

Within the dasher chamber a scouring paddle is continuously rotated by motor 26 to scour the sides of the chamber and prevent a build-up of ice on them. The scouring paddle is of standard design on these machines.

The dasher chamber is surrounded by a jacket 28 to which a condensed refrigerant is continuously supplied from condenser 30. The refrigerant boils in the jacket, and as it does so cools the brine mixture in the chamber to form ice crystals therein. The expanded refrigerant travels from the jacket to the compressor 32 where it is compressed and delivered to the condenser for continuous recycling as in a conventional refrigeration cycle.

As inidcated, the freezer, dasher chamber, scouring paddle and associated refrigeration circuit are standard and well known pieces of equipment and detailed reference is not made to them.

Reference to FIG. 2 will be made to explain the invention. This figure illustrates well known characteristics of a brine mixture wherein the solvent is water and the solute is NaCl.

This solution will freeze at the eutectic temperature or temperature of eutectic indicated on the figure. The physical phenomena that occur as the temperature of such a solution is cooled towards the freezing point depends upon its concentration. If the concentration is represented by a point to the left of the point $D_1$ on the curve ice crystals are formed and the concentration of the solution increases as the freezing temperature is approached.

The temperature represented by points D on the curve is known as the eutectic temperature and the concentration represented by the point $D_1$ on the curve is known as the eutectic concentration.

Referring to FIG. 2, if a solution of concentration x, less than the eutectic, at a temperature above 32F, is cooled, it will not solidfy when 32F is reached (point A), but continue to cool as a liquid until point B is reached. At this point, ice crystals of pure water will begin to form, accompanied by removal of their latent heat. This increases the concentration of the residual solution. As the temperature is lowered, these crystals continue to form, and the mixture of ice cyrstals and brine solution forms a slush. When point C is reached, there is a mixture of ice crystals $C_2$, and brine solution of concentration $C_1$, in the proportions of $1_1$ parts of brine to $1_2$ parts of ice crystals in $(1_1+1_2)$ parts of mixture. When the process has continued to point D, there is a mixture of $m_1$ parts of eutectic brine solution $D_1$, and $m_2$ part of ice $D_2$, all of the eutectic temperature. As more heat is removed, the $m_1$ parts of eutectic brine freeze at uniform temperature until all latent heat is removed. The frozen eutectic is a mechanical mixture of salt and frozen water, not a solution, and consequently the latent heat must be corrected for the heat of solution. If this is positive, it decreases effective latent heat; if negative, it increases the effective latent heat.

If the initial solution concentration is greater than the eutectic, salt instead of water freezes out as temperature lowers, and the concentration decreases until, at the eutectic temperature, eutectic concentration is reached. In brines used as refrigerating fluid, salt sometimes freezes out because concentration is too high.

With this invention one maintains a concentration of the brine less than the eutectic and preferably about point B on the eutectic curve. One does not cool to the eutectic temperature but does cool to form ice. As ice is formed, the ice and the concentrated mixture form a pumpable slush-like composition which is forced into the separator. Water is added to the mixture that is returned to the dasher chamber of the freezer from the supply 24 to maintain the concentration of the mixture workable for the production of ice as it is cooled.

By the addition of water to maintain the concentration of the solution at less than the eutectic concentration one supplies the water to make ice. The cylinder 10 is an especially efficient ice making device because it employs an efficient heat transfer from the refrigerant to the water that is formed into ice.

As the water freezes to take up its heat of crystalization, heat is taken up around the entire surface of the cyrstal that forms. It represents a very large surface area per unit of water.

With many ice making machines when the ice is formed by building a layer on a heat transfer surface of a cylinder the heat transfer surface is small by comparison.

It wil be apparent that with this method a certain amount of brine will be removed with the ice and provision is made for maintaining salt strength with concentrator 23. It can be operated to add salt as required.

The scouring paddle operates at a rate of speed that is fast enough to carry the cooled layer of mixture at the side wall towards the centre of the container before the cooled layer crystalizes on the side wall of the container. The paddle tends to move the cooled surface layer in a spiral path towards the longitudinal central axis of the chamber whereby it mixes with the general body of mixture in the chamber and cools the general body of mixture to form ice crystals throughout the body of the mixture. The speed will vary with equipment design and operating conditions but with two scouring blades and a cylindrical chamber having a diameter of about three inches a scouring paddle rotation of about 350 r.p.m. was found satisfactory.

The transformation of water from the liquid to the crystal or solid state takes place suddenly and requires a very substantial amount of energy. The liquid brine must be cooled below its freezing point before crystalization will take place. It is so cooled in a surface layer on the side of the chamber but in the interval before crystalization takes place the so cooled surface layer is moved by the rotating scouring paddle from the side wall of the container towards the centre of the container. The cooled liquid thus removed from the side wall surface of the chamber crystalizes into ice on the centers of crystalization present in the liquid. Thus, the brine acts as a secondary refrigerant in the formation of ice throughout the body of the mixture.

The paddles rotate around the heat exchange wall of the chamber and referably form a scoop angle therewith of about 45 degrees in the direction of rotation to force the cooled liquid towards the centre of the chamber on a continuous basis.

The system is a very efficient one for forming ice and provides for maximum contact of the brine with the heat exchange surface of the chamber.

As an example, a typical heat exchange chamber having a diameter of three inches has a heat transfer coefficient between the brine and refrigerant of 500 BTU's per hour per square foot per degree Farenheit and the temperature difference between the refrigerant and the brine is 10 degrees Farenheit.

Thus, the capacity of this unit is $500\times10=5000$ BTU's per hour per square foot of chamber wall.

The blades in the unit rotate and scour the sides of the chamber 350 times per minute and there are two of them so that the dwell time of the surfaced layer of mixture at the side wall of the chamber is $1/350\times2=0.00143$ minutes$=0.000024$ hours.

The heat given up by the brine mixture to the heat exchange wall in this time is $5000\times0.000024=01119$ BTU's per rotation of the blade per square foot.

To form ice requires 150 BTU's per pound of ice.

Thus, in one rotation of the auger there is sufficient heat exchange to form $0.119/150=0.00079$ pounds of ice per square foot of chamber wall.

Ice at 28 degrees Farenheit has a density of 57.3 lbs per cubic foot. Assuming that 0.00079 lbs per square foot of ice form on each rotation of the auger the maximum thickness of the ice layer before removal from the side of the chamber is $0.00079/57.3=0.000013$ inches. This is not enough to constitute an ice layer.

The diameter of the ice crystals harvested from the unit are between 0.002 and 0.003 inches. This is 154 to 384 times the thickness of ice that could be formed on the wall between scouring so that it is clear that with this rate of scouring crystals cannot grow to a harvestable size on the side wall of the heat exchnger. The 0.09 seconds that the brine contacts the wall is not sufficient for crystal formation.

The mixture adjacent the cooling surface of the container that is subcooled in this method is about 0.2 degrees Centigrade lower than the mixture freezing point. The heat given up by the brine to the heat exchanger is 0.119 BTU's per rotation of the blade per square foot of heat exchanger area. This amount of heat transfer represents a subcooling of the mixture to about 0.2 degrees Centigrade below its freezing point. In the method described in Svanoe patent referred to above the mixture close to the heat transfer surface is subcooled to about 3 to 8 degrees Centrigrade below the solution freezing point. This striking difference results from the basically different methods of scouring used according to this applicant's method and the method of Svanoe. In Svanoe there is not efficient removal of the subcooled liquid from immediately adjacent the heat transfer surface to avoid problems of ice formation in the area. Svanoe has a turbulent zone of substantial thickness at the heat transfer surface with the result that there is a higher degree of subcooling of a substantially greater volume of mixture. In Svanoe there are great temperature variations within the container. In the case of the present invention the subcooled layer is of infinitesimal thickness as noted above. The subcooled layer is removed as it is formed and at a fast rate so that apart from this very small volume the temperature is substantially the same throughout most of the volume of the container. It is more conducive to good crystal growth throughout the container for harvesting.

The scouring rate will vary with equipment and capacity but in every case the idea is to scour at a rate that avoids cooling substantially below the freezing point at the surface and crystal growth on the side of the heat exchanger chamber whereby to promote crystal growth and formation throughout the body of the mixture.

The mechanical scouring of the surface will achieve a high scouring rate capable of preventing crystal growth on the container wall. It gives a good yield of ice crystals. It will be apparent that for a given piece of equipment the yield of ice will increase with temperature rate of heat transfer. If the rate of heat transfer from the container wall to the mixture tends to be less than 4000 BTU's per square foot per hour of container wall the method becomes insufficient. High ice output for a given size piece of equipment is the key to successful operation. Rates of heat transfer of between 4000 and 5000 BTU's per square foot per hour are contemplated. The higher the rate the more efficient the operation as to capacity.

The method disclosed in the Svanoe patent disclosed above is not capable of operation at these production rates. Svanoe would not remove ice formation from the wall at this rate.

This method further achieves a vast improvement in machine capacity over a method wherein the crystals are permitted to grown on the wall of the chamber and are then harvested by scraping them from the wall with a lower speed auger. With such a method the temperature of the bulk of the mixture is always substantially above freezing and formation of ice crystals takes place only on the limited area of the wall of the chamber. It is not possible to form ice crystals in the bulk of the mixture that is above freezing temperature.

Further, the place of removal of the ice is not critical. It would in the apparatus illustrated be strained in the cylinder and make up water added to the cylinder.

Solutions other than brine could be used. The solvent should, of course, be water based to make ice but the solute could be any nontoxic material that has a suitable eutectic characteristic. Substitutes for salt might be glycerine, propylene glycol, ethanol or calcium chloride.

The ice crystals grow throughout the liquid rather than from the wall outward in a layer. Crystals that form near the wall may attach themselves to the wall but they are removed from the wall as the blades rotate. The growth throughout the liquid is acheived by prevention of larger build up at the cooled surface by mechanical scouring at a rate so that the temperature at the wall is not more than one degree centigrade below freezing point and is preferably no more than 0.2 degrees centigrade less than freezing point.

The foregoing example is of a subcooling of about 0.2 degrees centigrade. The subcooling throughout the mixture cannot be more than this. The amount of subcooling with this invention is necessarily small because the subcooled layer must be removed before it grows to any appreciable size. Subcooling up to one degree centegrade at the surface is contemplated. Greater subcooling than this would result in poor heat transfer.

The unit with a chamber diameter of three inches and three feet in length referred to above has been operated according to this invention to produce 400 pounds of ice per hour. Water is preferably added at a constant rate on a continuous basis but it can be added at intervals provided that the concentration of the brine does not get too high. If the concentration gets too high the process becomes less efficient and if it becomes so high that it passes the eutectic point salt will be deposited in the tank. As concentration gets high ice yield gets low. If concentration is too low one gets too much ice for easy mechanical operation of the unit. Separation of ice from the slush can be done manyu ways including centrifugal. Many modification of the method are possible as will be apparent to those skilled in the art.

What I claim as my invention is:

1. A continuous method for making ice in a container having a wall and means for continuously cooling said wall of the container comprising the steps of:

making a solution wherein the solvent is water, the solute is nontoxic and the initial concentration is less than the eutectic concentration;

containing the solution within said container, the solution beingin heat exchange relation with the said wall of the container;

continuously cooling the wall of the container to cool the layer of solution immediately adjacent the side wall below its freezing point with a refrigerant;

continuously moving a blade across and in contact with the wall of the container to carry the cooled layer of mixture at said wall towards the centre of the container;

the rate of movement of the blade across the wall of the container being fast enough to carry the cooled layer of solution at the wall towards the centre of the container as aforesaid before the cooled layer is crystalized into a layer of ice whereby to maintain the temperature of the mixture substantially uniformly throughout the container below its freezing point and form water ice crystals of harvestable size suspended throughout the body of the mixture in the container;

harvesting formed ice crystals from suspension in said solution; and continuously replenishing said solution in said chamber as said water ice crystals are removed.

2. A continuous method for making ice crystals as claimed in claim 1 wherein the harvesting of said ice crystals is effected by pumping said solution with its ice crystals in suspension from said container and mechanically separating and removing the ice crystals, the rate of forming of ice crystals being at a speed to cause their formation in the container as the solution is continuously pumped as aforesaid, the said solution after separation of the ice therefrom being returned to said container.

3. A continuous method for making ice crystals as claimed in claim 1 wherein said solution replenished by adding make-up solution adjusted to duplicate the initial concentration thereto to replace solution removed therefrom by the removal of said water ice crystals.

4. A continuous method for making ice cyrstals as claimed in claim 1 wherein said solution is brine.

5. A continuous method for making ice crystals as claimed in claim 4 wherein the harvesting of said ice crystals is effected by pumping said solution with its ice crystals in suspension from said container, and mechanically separating and removing the ice crystals, the rate of forming of ice crystals being at a speed to cause their formation in the container as the mixture is continuously pumped as aforesaid, the said solution after separation of the ice therefrom being returned to said container.

6. A continuous method for making ice crystals as claimed in claim 4 wherein said solution is replenished by adding make-up solution adjusted to duplicate the initial concentration thereto to replace mixture removed therefrom by the removal of said water ice crystals.

7. A method of continuously forming ice from a body of solution located within a container wherein the solvent is water, the solute is non toxic and the initial concentration is less than the eutectic concentration comprising the steps of passing a portion of said solution across a cooled surface of said container to extract heat from said portion and maintain the temperature of the solution at the cooled surface below the freezing point of the water in said solution, removing said portion from said surface by moving a blade across and in contact with said surface prior to deposition of a layer of crystalised water on said surface and distributing said portion throughout said body of mixture by continued movement of said blade to maintain said body of solution at a substantially uniform temperature below said freezing point within said container to promote crystalisation of water substantially uniformly thoughout said body of solution.

8. A method according to claim 7 including the step of removing said solution and crystalised water from said container and separating said solution and crystalised water.

9. A method according to claim 8 including the step of recirculating solution separated from said crystalised water to said container.

10. A method according to claim 9 including the step of adding water to the recirculated solution to restore the relative proportions of solvent and solute to that of the solution prior to formation of the crystalised water.

11. A method according to claim 10 including the step of maintaining the temperature of said portion at said cooled surface at not more than 1 degree centigrade below the freezing point of water in said solution.

12. A method according to claim 11 wherein the temperature of said portion is maintained at not more than 0.2 degrees centigrade below the freezing point of water in said solution.

13. A method according to claim 7 wherein said surface is cooled at a rate of at least 4000 BTU's per square foot per hour.

14. A method according to claim 7 wherein the solute is selected from the group comprising salt, glycerine, propylene glycol, ethanol or calcium chloride.

15. A method according to claim 7 wherein the interval between successive removals of said portion from said surface is not less than 0.00143 minutes.

* * * * *